US007721868B2

(12) United States Patent
Wilfer

(10) Patent No.: US 7,721,868 B2
(45) Date of Patent: May 25, 2010

(54) METHOD FOR ADJUSTING A BANKNOTE PROCESSING MACHINE

(75) Inventor: Kurt Wilfer, Oberschleissheim (DE)

(73) Assignee: Giescke & Devrient GmbH, Munich (DE)

( * ) Notice: Subject to any disclaimer, the term of this patent is extended or adjusted under 35 U.S.C. 154(b) by 363 days.

(21) Appl. No.: 11/629,470

(22) PCT Filed: Jun. 14, 2005

(86) PCT No.: PCT/EP2005/006364

§ 371 (c)(1),
(2), (4) Date: Jun. 25, 2007

(87) PCT Pub. No.: WO2005/124701

PCT Pub. Date: Dec. 29, 2005

(65) Prior Publication Data

US 2008/0289929 A1 Nov. 27, 2008

(30) Foreign Application Priority Data

Jun. 17, 2004 (DE) ..... 10 2004 029 270

(51) Int. Cl.
*G07D 7/00* (2006.01)

(52) U.S. Cl. ..... 194/302

(58) Field of Classification Search ..... 194/302
See application file for complete search history.

(56) References Cited

U.S. PATENT DOCUMENTS 5,931,277 A 8/1999 Allan et al.
6,012,565 A * 1/2000 Mazur ..... 194/207
2003/0121753 A1 * 7/2003 Stromme et al. ..... 194/207
2006/0011447 A1 1/2006 Hornung et al.

FOREIGN PATENT DOCUMENTS

| | | | |
|---|---|---|---|
| DE | 31 39 447 | A1 | 6/1982 |
| DE | 101 17 250 | A1 | 10/2002 |
| DE | 102 31 409 | A1 | 1/2004 |
| EP | 0 779 604 | A1 | 6/1997 |
| EP | 1 434 177 | A2 | 6/2004 |
| GB | 2 088 832 | A | 6/1982 |
| WO | WO 98/35323 | | 8/1998 |

* cited by examiner

*Primary Examiner*—Patrick Mackey
*Assistant Examiner*—Mark Beauchaine
(74) *Attorney, Agent, or Firm*—Bacon & Thomas, PLLC

(57) ABSTRACT

The invention relates to a method for adjusting a bank note processing machine by which threshold values of sensors are defined for recognizing the condition of bank notes.

Figure 1:
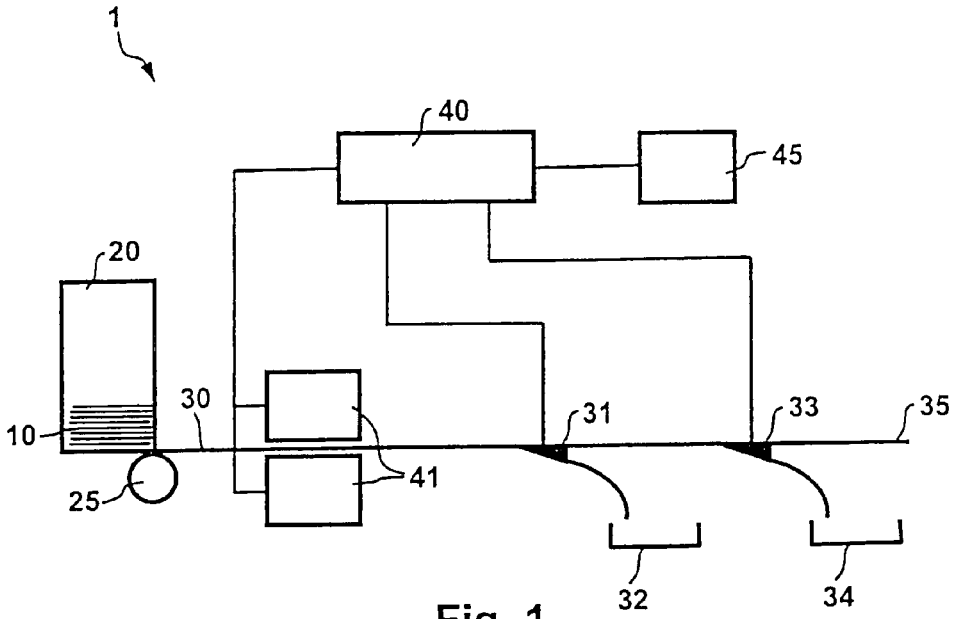

The invention starts out from a method for adjusting a bank note processing machine by which threshold values of sensors are defined for recognizing the condition of bank notes, whereby a number of bank notes is processed by means of the bank note processing machine and data of at least one sensor are stored, the condition of the bank notes is recognized by means of the stored data and at least one threshold value, a relation between the recognized condition of the bank notes and the at least one threshold value is determined and displayed, at least one threshold value is changed on the basis of the displayed relation, and at least the condition and the relation are determined again and the relation is displayed again.

4 Claims, 2 Drawing Sheets

METHOD FOR ADJUSTING A BANKNOTE PROCESSING MACHINE

This invention relates to a method for adjusting a bank note processing machine by which threshold values of sensors are defined for recognizing the condition of bank notes.

In known methods for adjusting bank note processing machines by which threshold values of sensors are defined for recognizing the condition of bank notes, it is necessary for an operator to select and define suitable threshold values for the sensors. The threshold values defined by the operator are then used for separating the bank notes to be processed, according to their condition, into bank notes fit for circulation and ones unfit for circulation by means of the bank note processing machine, for which purpose the bank notes are sorted by the bank note processing machine into different output pockets, for example.

The disadvantage of known methods is primarily that it is very complicated and elaborate for the operator to define suitable threshold values for the sensors of the bank note processing machine. He starts out for example from threshold values already given by the manufacturer of the bank note processing machine, which are firmly set. Problems arise e.g. from aging or soiling of the bank note processing machine or from changes in the bank notes to be processed. If one or more of the threshold values are set even only slightly too high by the operator, bank notes that are actually no longer suitable for circulation are classified as fit for circulation by the bank note processing machine. However, if one or more of the threshold values are set even only slightly too low by the operator, bank notes that are actually suitable for circulation are classified as no longer fit for circulation by the bank note processing machine. Thus the bank notes to be processed are not separated into bank notes fit for circulation and those unfit for circulation in the way desired by the operator.

DE 102 31 409 A1 proposes, for solving these problems, defining the threshold values of sensors for recognizing the condition of bank notes by selecting at least one bank note fit for circulation and at least one bank note unfit for circulation, processing the selected bank notes by means of the bank note processing machine, whereby data of at least one sensor are stored, and defining at least one threshold value for the at least one sensor by evaluating the stored data of the at least one sensor.

This makes it possible for an operator of the bank note processing machine to alter the threshold values of the sensors any time without any complicated adjusting operations by supplying a selection of bank notes fit for circulation and ones unfit for circulation. The selection of bank notes fit for circulation and ones unfit for circulation is processed by the bank note processing machine in a special processing mode, and the threshold value or values are defined by the bank note processing machine, or its control device, automatically according to the bank note properties given by the selection of bank notes fit for circulation and ones unfit for circulation. Since the processing of the selection of bank notes fit for circulation and ones unfit for circulation by the bank note processing machine is effected in the way known to the operator from all other processing operations or processing modes, this provides a simple method for defining the threshold values which is carried out without any intervention or without any control by the operator.

Alternatively, it is provided that the operator specifies a rate for the bank notes classified as unfit for circulation, e.g. in percent. If the operator stipulates for example that 10% of all bank notes are to be classified as unfit for circulation, a corresponding value is input by the operator and a certain quantity of selected bank notes is input into the bank note processing machine. The control device then defines the threshold values by analyzing all input bank notes, e.g. how high the soiling and/or the damage, etc., of the individual bank notes is. On the basis of this analysis the 10% of the inserted bank notes that have the highest soiling and/or damage, etc., are used for defining the threshold values.

The procedure proposed in DE 102 31 409 A1 substantially relieves the operator, since the definition of threshold values is effected automatically and the operator substantially only has to make a number of suitable bank notes available, i.e. a number of bank notes fit for circulation and a number of bank notes unfit for circulation. However, for the operator it is still problematic to make a suitable quantity of bank notes fit for circulation and ones unfit for circulation available. In the proposed alternative, i.e. stipulation of a certain rate of bank notes unfit for circulation, it is hardly foreseeable by the operator what effect this stipulation will have in the recognition of bank notes fit for circulation and ones unfit for circulation.

It is therefore the problem of the present invention to specify a method for adjusting a bank note processing machine by which threshold values of sensors are defined for recognizing the condition of bank notes in such a way that an operator can judge the effect of a change of threshold values any time, even in random bank notes not previously selected according to special criteria.

This problem is solved by the features of a method for adjusting a banknote processing machine as disclosed herein.

The invention starts out from a method for adjusting a bank note processing machine by which threshold values of sensors are defined for recognizing the condition of bank notes, whereby a number of bank notes is processed by means of the bank note processing machine and data of at least one sensor are stored, the condition of the bank notes is recognized by means of the stored data and at least one threshold value, a relation between the recognized condition of the bank notes and the at least one threshold value is determined and displayed, at least one threshold value is changed on the basis of the displayed relation, and at least the condition and the relation are determined again and the relation is displayed again.

The invention makes it possible, by the determination and display of the relation between the recognized condition of the bank notes and the threshold values, to define the threshold values by means of a number of bank notes such that the recognition of the bank note condition has desired properties. It is possible to use any bank notes for adjusting the threshold values here, i.e. it is not imperative to arduously select bank notes with certain properties with regard to their condition.

Further advantages of the present invention can be found in the following description of an embodiment with reference to the figures.

Figure 2:
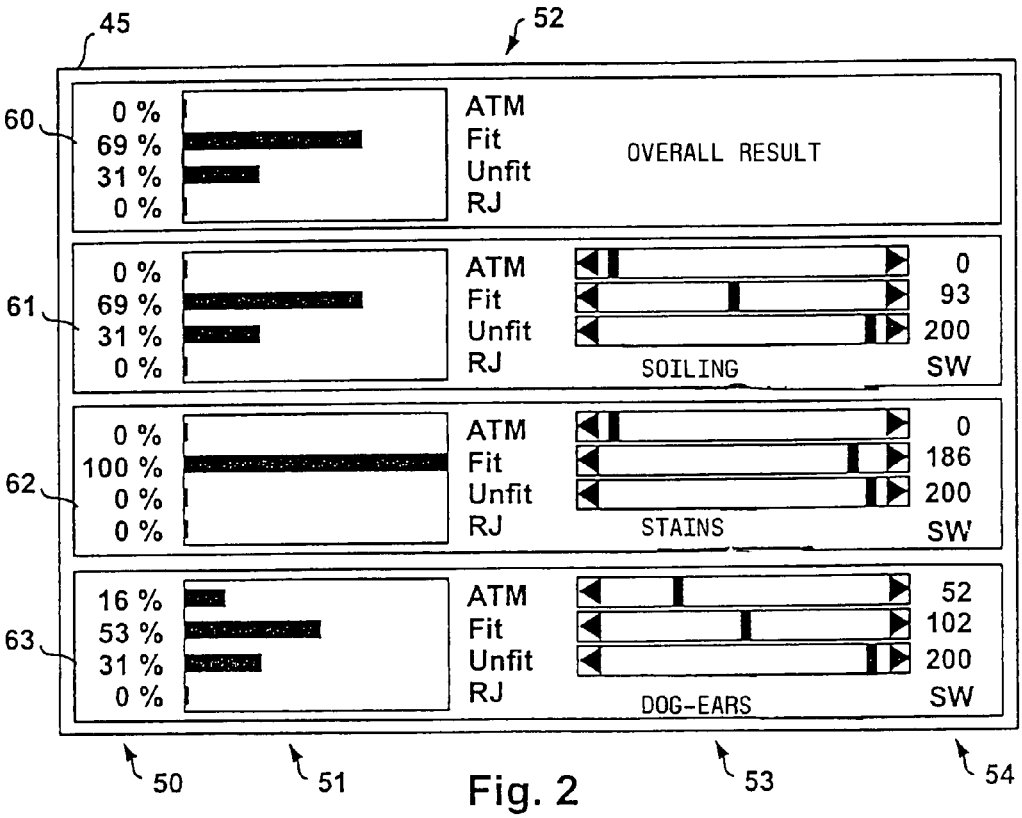
Figure 3:
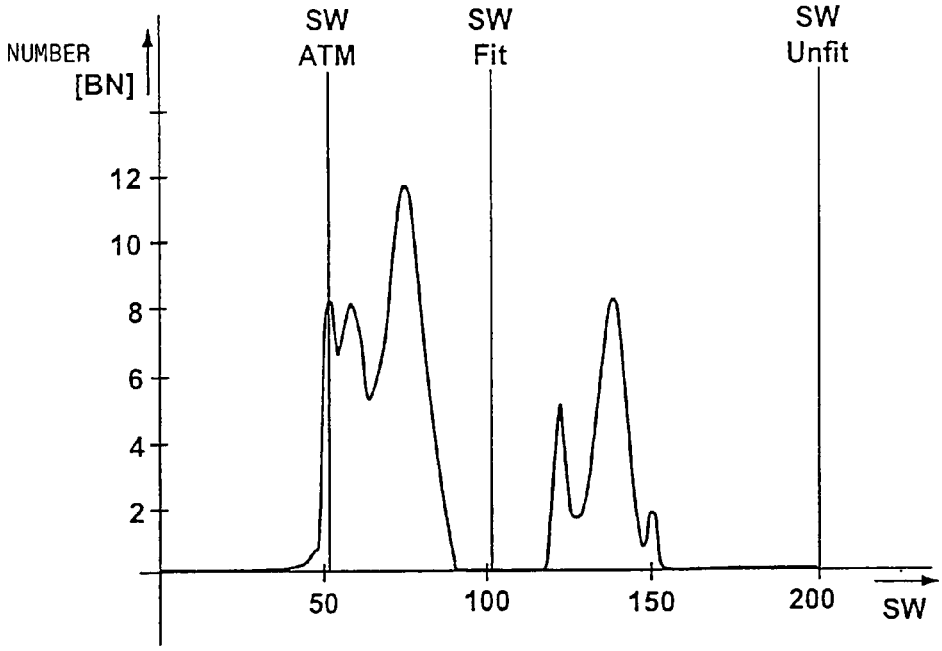

The figures are described as follows:

FIG. 1 a schematic structure of a bank note processing machine for carrying out a method for adjusting the bank note processing machine by which threshold values of sensors are defined for recognizing the condition of bank notes, FIG. 2 a display of the bank note processing machine from FIG. 1, FIG. 3 a distribution of bank notes, in dependence on a property influencing the condition of the bank notes, and FIG. 4 a detail of the display from FIG. 2.

FIG. 1 shows a bank note processing machine 1 having an input pocket 20 into which bank notes 10 to be processed can be inserted, i.e. bank notes that are to be separated according to their condition into bank notes fit for circulation and ones unfit for circulation. The bank notes 10 are grasped by a singular 25 singly, one after the other, and transferred to a transport system 30. The transport system 30 transports the single bank notes through a measuring device 41.

The measuring device 41 contains at least one sensor whose signal indicates the condition of the particular bank note to permit a judgment and classification of the bank note as fit for circulation or unfit for circulation to be performed. The sensor or sensors of the measuring device 41 may be for example optical sensors as well as suitable light sources, the sensors detecting light reflected by the particular bank note or transmitted through the particular bank note, e.g. light of a certain wavelength or wavelength range. Further sensors can evaluate for example acoustic and/or mechanical and/or thermal and/or magnetic and/or electrical and/or chemical properties, etc., of the particular bank note. By means of the stated sensors it is possible to make statements about the condition, e.g. whether the particular bank note is soiled or damaged, or whether it has alien elements such as clips or adhesive tape which influence the fitness for circulation of the particular bank note.

Using the signals provided by the measuring device 41, a control device 40, which can be formed e.g. by a microprocessor with an associated memory, determines whether the particular bank note is a bank note fit for circulation or one unfit for circulation. For this purpose the control device 40 compares the signals provided by the measuring device 41 with given threshold values which are stored e.g. in the memory of the control device 40.

In dependence on the condition of the bank note as ascertained by the control device 40, the control device 40 drives gates 31 and 33 in the transport system 30 for depositing bank notes fit for circulation in a first output pocket 32 and bank notes unfit for circulation in a second output pocket 34, for example. Further gates or output pockets, shredders, etc., can be provided in the transport system 30 of the bank note processing machine 1 and are indicated by a continuation 35.

An input/output device 45 connected to the control device 40 and consisting e.g. of a keyboard and a display is used for operation of the bank note processing machine 1 by an operator. The keyboard can be used for entering commands or selecting processing modes, and the display can indicate processing results or instructions asking the operator to perform certain actions.

For adjusting or selecting one or more threshold values for judging the condition of bank notes, the operator selects a random quantity of bank notes. Bank notes can be contained that are judged as unfit for circulation, i.e. these bank notes have irregularities such as soiling, defects, clips, adhesive tape, etc. Bank notes can likewise be contained that are classified as fit for circulation, i.e. these bank notes have e.g. no more than low soiling and/or damage which is not felt to be disturbing. However, the quantity of bank notes can consist of random bank notes without them having to be previously selected or classified by the user with regard to their condition.

By means of the input/output device 45 the operator selects an operating mode of the bank note processing machine 1 in which the one or more threshold values can be defined for determining the condition of bank notes.

Under the control of the control device 40, the operator is then for example asked by the input/output device 45 to insert the bank notes into the input pocket 20. The bank notes are singly grasped by the singular 25 and transferred to the transport system 30. The measuring device 41, or the sensor or sensors contained therein, determine signals representative of the particular bank note which are transmitted to the control device 40. The data of the signals of the measuring device 41 can be stored in the memory of the control device 40 in unchanged form. It is likewise possible that the signals of the measuring device 41 are processed by the control device 40, the data of the result obtained during processing being stored. Under the control of the control unit 40, the processed bank notes are transported by the transport system 30 into the output pockets 32, 34, for example. At the same time, a distinction can be made into bank notes fit for circulation and ones unfit for circulation, but the bank notes can also all be transported into one of the output pockets 32, 34.

For distinguishing the bank notes according to their condition into bank notes fit for circulation and ones unfit for circulation, at least one threshold value defined e.g. during manufacture of the bank note processing machine 1 is stored in the memory of the control device 40. To permit a reliable distinction of bank notes fit for circulation and ones unfit for circulation, separate threshold values must be used for each kind of bank note (currency and denomination), since each kind of bank note has special properties that as a rule differ greatly from bank notes of another kind.

Further, it is possible to perform further distinctions that depend on the condition of the bank notes, besides the described distinction of bank notes fit for circulation and ones unfit for circulation. For example, it is possible to define additional threshold values for bank notes that are suitable for use in an automatic cash dispenser. Such bank notes must as a rule meet higher demands with regard to their condition than bank notes fit for circulation in general.

Also, the term "threshold value" is not only intended to refer to a value firmly set for one or more of the sensors of the measuring device 41. Rather, it is also possible to provide functions, interpolations, approximations, etc., describing a discriminant function that permits the bank notes under examination to be separated in the desired way.

FIG. 2 shows a display of the input/output device 45. The display is subdivided by way of example into a plurality of areas 60 to 63 which display data related to the adjustment of the bank note processing machine 1, or condition properties of bank notes. For example, preset or presettable different threshold values 52 are shown in the form of slide controls 53 and/or stated values 54. Further, the effect of the adjusted threshold values 52 on the condition check is shown for example in the form of histograms 51 and/or percentages 50.

For adjusting the bank note processing machine 1, bank notes 10 are inserted into the input pocket 20 of the bank note processing machine 1 and processed, as described above, to define the threshold values of sensors for recognizing the condition of bank notes. At the same time, in particular the data of the processed bank notes 10 determined by the sensors of the measuring device 41 are stored in the memory of the control device 40. For this purpose, the given values 54 are used for judging soiling 61, stains 62 and dog-ears 63 in the example shown in FIG. 2. Soiling is understood in this context to mean a more or less uniform coating of dirt of any kind which makes the bank notes look quite generally darker. Stains are understood to mean soiled or smeared places that are locally limited and greatly influence the general optical impression. Dog-ears are understood to mean partial areas of the bank note that are missing or turned down in the corner areas of the bank note.

The effect of the given values 54 on the condition check for the different condition properties 61, 62, 63 is shown by means of histograms 51 and/or percentages 50 for the different threshold values 52. Additionally, the overall result 60 of the judgment of the condition of the bank notes 10 performed by the bank note processing machine 1 is shown, which is composed of the results of the different condition properties 61, 62, 63. The different threshold values 52 are to represent different quality requirements, whereby the threshold value "ATM" stands for bank notes whose condition is very good, so that these bank notes are suitable for use in automatic cash dispensers. The threshold value "Fit" stands for bank notes whose condition is good, so that these bank notes can be returned to general circulation. The threshold value "Unfit" stands for bank notes whose condition is poor, so that these bank notes cannot be returned to circulation. The additional term "RJ" is not a threshold value, but the rate of bank notes that could not be clearly judged, e.g. because they were not transported properly through the bank note processing machine 1.

FIG. 3 shows a statistical distribution of bank notes, in dependence on a property influencing the condition of the bank notes, namely the dog-ears 63. The shown distribution results for the bank notes 10 processed by the bank note processing machine 1 with the given values 54 for the threshold values 52. In the shown example, the stated values 54 for the threshold values 52 are normalized values which can be in a value domain from 0 to 200 in the shown example. Here, 0 is the highest and 200 the lowest requirement for the quality of the condition property to be judged. For clarification and better comprehension of the effects of the given, or altered, threshold values 52, the statistical distribution shown in FIG. 3 can additionally be displayed by the control device 40 on the display of the input/output device 45, e.g. in the particular area, here the area 63 containing the condition property, dog-ears. For clarifying the effect of the threshold values 52 during judgment of the condition of the bank notes by the bank note processing machine 1, the stated values 54 for the individual threshold values 52 are shown for this purpose as lines SW ATM, SW Fit and SW Unfit in the statistical distribution. This makes it immediately possible to recognize the distribution of bank notes within the areas given by the threshold values 52 in each case, in accordance with the different quality requirements.

Figure 4A:
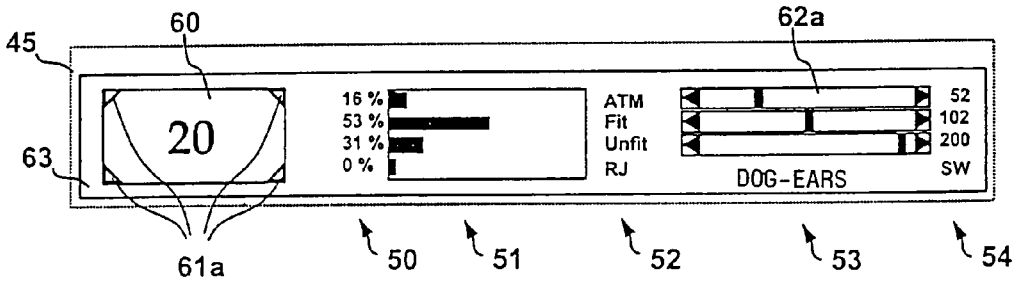
Figure 4B:
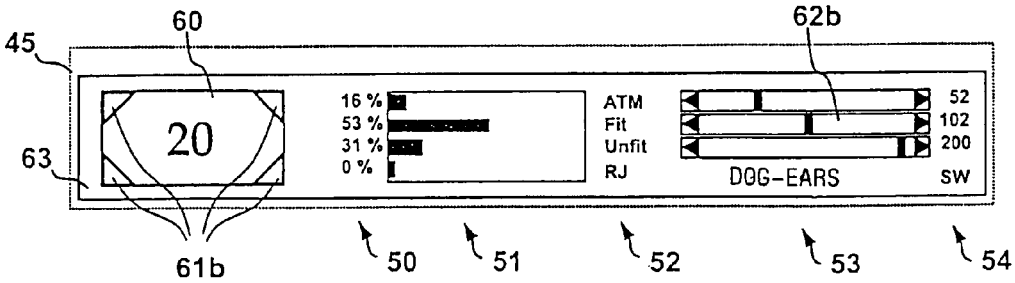

As shown in FIG. 4, it can for example also be displayed in the particular area, here the area 63 containing the condition property, dog-ears, how individual stated values 54 for the threshold values 52 influence the judgment or evaluation of different bank notes 60, i.e. which surface areas 61*a* of the bank notes 60, in dependence on the threshold value 52, are considered during judgment. FIG. 4*a* indicates that the surface areas 61*a* of the bank note 60, in the shown example a bank note of the denomination 20, for the threshold value 52 of bank notes suitable for automatic cash dispensers (ATM) have a smaller size 62*a* than the surface area 61*b*, shown in FIG. 4*b*, for threshold value 52 of bank notes 62*b* suitable for circulation (Fit). The different size of the surface areas 61*a*, 61*b* considered on the bank note 60 during judgment results from the different quality requirements for bank notes suitable for automatic cash dispensers and ones suitable for circulation. Since bank notes suitable for automatic cash dispensers must meet higher quality requirements, the considered surface areas 61*a* of the bank note 60 are smaller, because the quality required by the stated value 54 of the threshold value 52 is already no longer given if dog-ears with the size characterized by the surface area 61*a* are present. Because of the less strict quality requirements for bank notes suitable for circulation, the surface area 61*b* is in this case accordingly larger.

For adjusting the threshold values 52, a change of one or more of the threshold values 52 is performed, starting out from the given threshold values 52 and the above-described processing of the bank notes 10 as well as the described processing of the results by means of the control device 40 and the display of the input/output device 45. For the changed threshold values 52 a processing of the bank notes 10 is again performed by the control device 40 and the resulting changes of the evaluations of the condition of the bank notes 10 are marked, e.g. by a change of the histogram or histograms 51 or percentages 50. Another physical processing of the bank notes 10 by the bank note processing machine 1 is unnecessary here since the data of the sensors of the measuring device 41 were stored in the memory of the control device 40 upon the first processing. However, it is also possible to repeat the physical processing.

The change of one or more threshold values 52 can be carried out for one or more properties 61 to 63 influencing the condition, and repeated until a desired result is achieved. The change of the threshold values 52 can be carried out here by inputting numerical values for the stated values 54, e.g. by means of the keyboard of the input/output device 45. Likewise, the elements of the display formed as slide controls 53 can be shifted to carry out a change of the threshold values 52. For this purpose, the display of the input/output device 45 can be designed e.g. as a touch-sensitive display. A further possibility is to shift the threshold values SW ATM, SW Fit and SW Unfit shown as lines, in the statistical distribution shown in FIG. 3.

For carrying out the adjustment of the threshold values 52, one bank note in good condition and one bank note in poor condition are theoretically sufficient. It has proved advantageous, however, to use a larger number of bank notes, e.g. 10,000 bank notes. The bank notes can consist of a random mixture of bank notes in good and poor condition as long as both a sufficient number of bank notes in good condition and a sufficient number of bank notes in poor condition are present. Bank notes in poor condition and bank notes in good condition can of course also be selected and used for adjustment, or bank notes in a certain condition or with certain condition properties, e.g. dog-ears, can be selectively added to a random quantity of bank notes.

The invention claimed is:

1. A method for adjusting a bank note processing machine by which threshold values of sensors are defined for recognizing the degradation of bank notes, comprising the steps:

a) processing a number of bank notes by means of the bank note processing machine, whereby data of at least one sensor are stored, b) recognizing the degradation of the bank notes by means of the stored data and at least one threshold value, c) determining and displaying a relation between the recognized degradation of the bank notes and the at least one threshold value, d) changing at least one threshold value on the basis of the displayed relation and at least repeating the steps b) to c), and e) sorting fit and unfit banknotes based on the at least one change threshold value.

2. The method according to claim 1, wherein the relation between the recognized degradation of the bank notes and the at least one threshold value characterizes a condition property.

3. The method according to claim 1, wherein the relation between the recognized degradation of the bank notes and the at least one threshold value characterizes all condition properties considered during recognition of the degradation.

4. A bank note processing machine for carrying out the method according to claim 1.

* * * * *